US005384820A

United States Patent [19]

Burke

[11] Patent Number: 5,384,820

[45] Date of Patent: Jan. 24, 1995

[54] JOURNAL BEARING AND RADIATION SHIELD FOR ROTATING HOUSING AND ANODE/STATIONARY CATHODE X-RAY TUBES

[75] Inventor: James E. Burke, Villa Park, Ill.

[73] Assignee: Picker International, Inc., Highland Hts., Ohio

[21] Appl. No.: 93,055

[22] Filed: Jul. 16, 1993

Related U.S. Application Data

[63] Continuation-in-part of Ser. No. 988,403, Dec. 9, 1992, Pat. No. 5,274,690, which is a continuation-in-part of Ser. No. 817,294, Jan. 6, 1992, Pat. No. 5,241,577, Ser. No. 817,295, Jan. 6, 1992, Pat. No. 5,200,985, Ser. No. 817,296, Jan. 6, 1992, abandoned, and Ser. No. 862,805, Apr. 3, 1992, Pat. No. 5,268,955.

[51] Int. Cl.[6] ..... H01J 35/04

[52] U.S. Cl. ..... 378/135; 378/130; 378/133; 378/140

[58] Field of Search ..... 378/135, 125, 130, 132, 378/133, 140, 141, 142, 143, 144, 203

[56] References Cited

U.S. PATENT DOCUMENTS

| | | | |
|---|---|---|---|
| 2,233,194 | 2/1941 | Atlee et al. | 378/125 |
| 2,900,543 | 8/1959 | Heuse | 378/130 |
| 4,884,292 | 11/1989 | Klostermann | 378/203 X |

*Primary Examiner*—David P. Porta

*Attorney, Agent, or Firm*—Fay, Sharpe, Beall, Fagan, Minnich & McKee

[57] ABSTRACT

A housing (A) which has a radiation transmissive window (52) defines a coolant oil reservoir (50). An x-ray tube (B) is mounted within the cooling oil reservoir. The x-ray tube includes a vacuum envelope having a cylindrical wall portion (10). A cylindrical sleeve (70) is mounted around the cylindrical wall (10) defining a narrow coolant oil gap (100). In one embodiment, a motor (16) rotates the vacuum envelope and an anode (14). The cylindrical sleeve (70) and the cylindrical rotating vacuum envelope wall portion (10) with the cooling oil film in the gap define a journal bearing which minimizes the horsepower requirements of the motor (16). A diaphragm (102) is expanded to reduce the thickness of the coolant oil film in the journal bearing gap. The cylindrical sleeve (70) is preferably constructed of a radiation blocking material such that the body of coolant oil (50) is shielded from x-rays (42). A window (76) is defined in alignment with the housing window (52) such that a beam of x-rays is permitted to leave the assembly. A radiation blocking disk (84) is mounted between the cathode and one end of the tube to block radiation exiting in that direction. The anode blocks radiation from exiting in the other direction. Optionally, an additional cylinder of radiation blocking material (86) may be mounted between the cathode and the cylindrical sleeve (70).

25 Claims, 5 Drawing Sheets

JOURNAL BEARING AND RADIATION SHIELD FOR ROTATING HOUSING AND ANODE/STATIONARY CATHODE X-RAY TUBES

This application is a continuation-in-part of U.S. application Ser. No. 07/988,403 filed Dec. 9, 1992, now U.S. Pat. No. 5,274,690 which, in turn, is a continuation-in-part of U.S. application Ser. No. 07/817,294, now U.S. Pat. No. 5,241,577; U.S. Ser. No. 07/817,295, now U.S. Pat. No. 5,200,985; and Ser. No. 07/817,296, non abandoned, all filed Jan. 6, 1992, and U.S. application Ser. No. 07/862,805, now U.S. Pat. No. 5,268,955 filed Apr. 3, 1992.

BACKGROUND OF THE INVENTION

The present invention relates to the x-ray tube art. It finds particular application in conjunction with high power x-ray tubes for use with CT scanners and the like and will be described with particular reference thereto. It will be appreciated, however, that the invention will also have other applications.

Typically, a high power x-ray tube includes an evacuated envelope or housing which holds cathode filament through which a heating current is passed. This current heats the filament sufficiently that a cloud of electrons is emitted, i.e. thermionic emission occurs. A high potential, on the order of 100–200 kV, is applied between the cathode and an anode which is also located in the evacuated envelope. This potential causes the electrons to flow from the cathode to the anode through the evacuated region in the interior of the evacuated envelope. The electron beam impinges on a small area of the anode or focal spot with sufficient energy that x-rays are generated and extreme heat is produced as a by-product.

In high energy x-ray tubes, the anode is rotated at a high speed such that the electron beam does not dwell on only the small spot of the anode long enough to cause thermal deformation. The diameter of the anode is sufficiently large that in one rotation of the anode, each spot on the anode that was heated by the electron beam has substantially cooled before returning to be reheated by the electron beam. Larger diameter anodes have larger circumferences, hence provide greater thermal loading. In conventional rotating anode x-ray tubes, the envelope and the cathode remain stationary while the anode Forages inside the envelope. Heat from the anode is dissipated by the thermal radiation through the vacuum to the exterior the vacuum envelope. It is to be appreciated that heat transfer from the anode through the vacuum is limited.

High power x-ray tubes have been proposed in which the anode and vacuum envelope rotate, while the cathode filament inside the envelope remains stationary. This configuration permits a coolant fluid circulate in directed contact with the anode to provide a direct thermal communication between the anode and the exterior of the envelope. See for example, U.S. Pat. Nos. 5,046,186: 4,788,705; 4,878,235; and 2,111,412.

More specifically, an outer housing is provided which has the window through which x-rays emerge. The anode and vacuum envelope are rotatably mounted within the housing and displaced a significant distance therefrom. The chamber between the housing and the vacuum envelope is filled with a coolant oil. Connections are provided on the housing for withdrawing the oil, pumping it through a radiator or other cooling system, and returning the cooled oil to the housing. When x-rays are generated at the focal point on the anode, x-rays are emitted in substantially all directions. Because the anode has a high x-ray blocking power, x-rays are effectively emitted over a hemispherical volume defined over the focal point where the electron beam from the cathode strikes the anode surface. These high energy x-rays pass through the vacuum envelope into the coolant oil. The coolant oil is highly radiation transparent such that x-rays passes through the oil in the reservoir to the window without significant attenuation.

One of the difficulties with this configuration is that x-ray tube oil that has good thermal characteristics does not necessarily have a high x-ray tolerance. Quite to the contrary, many high temperature cooling oils are degraded badly by x-rays.

Another difficulty with this configuration is that the focal point where the electron beam is focused on the anode to cause the generation of x-rays is not truly a point. Rather, x-rays are generated over an area of some physical size. In CT scanners and other precision x-ray equipment, the x-rays from other than the theoretical point source, known as off-focal radiation, tend to degrade the resultant image. To limit off-focal radiation, collimators are commonly installed as a part of the housing window. Although collimators are and can be provided in other portions of the CT scanner, off-focal radiation collimation in the window is preferred because it has been found that collimating for off-focal radiation as close to the x-ray source as possible is the most effective.

Another difficulty with this configuration is that there is significant frictional drag between the rotating vacuum envelope and the coolant oil. An order to run the high powered x-ray tubes on a continuous duty cycle, the anode is typically run at a relatively nigh velocity. A relatively large horsepower motor is required to overcome the frictional drag of the coolant fluid on the rotating envelope.

The present invention provides a new and improved construction which overcomes the above-referenced problems and others.

SUMMARY OF THE INVENTION

In accordance with one aspect of the present invention, an x-ray tube assembly includes a housing which defines a coolant fluid reservoir and an x-ray transmissive window in combination with an x-ray tube mounted in the reservoir. The x-ray tube includes a vacuum envelope that has a cylindrical wall portion, a anode having an annular anode surface disposed generally transverse to a central axis of the cylindrical wall portion, a cathode mounted within the vacuum envelope, and a means for causing relative rotational movement between the anode surface and the cathode. An annular sleeve of radiation blocking material is disposed adjacent the vacuum envelope cylindrical wall portion. The radiation blocking sleeve defines a radiation passing window generally in alignment between the housing window and the annular anode surface.

In accordance with more limited aspects of the present invention, additional radiation opaque elements are disposed adjacent cathode and anode ends of the evacuated envelope.

In accordance with other more limited aspects of the present invention, a means for causing relative rotation includes a motor for rotating the evacuated envelope and the anode about the central axis and a means for holding the cathode generally stationary within the rotating evacuated envelope.

In accordance with yet more limited aspects of the present invention, the radiation blocking sleeve is mounted to one of a radiation blocking disk mounted within the evacuated envelope, connected with the cylindrical wall portion, or stationarily mounted displaced from the cylindrical wall portion by a thin gap.

In accordance with another aspect of the present invention, an x-ray tube assembly is provided. The assembly includes a housing having a cooling fluid holding reservoir and an x-ray permeable window. An x-ray tube which is disposed in the coolant fluid reservoir includes a vacuum envelope having a cylindrical wall portion. The vacuum envelope is mounted within the housing for rotation about a central axis of the cylindrical wall portion. A cylindrical sleeve is disposed around the cylindrical vacuum envelope wall portion defining a thin gap therebetween which receives a thin layer of the coolant fluid. In this manner, the cylindrical wall portion, the cylindrical sleeve, and the coolant fluid define a journal bearing.

In accordance with a more limited aspect of the present invention, the cylindrical sleeve is radiation opaque.

One advantage of the present invention is that it reduces horsepower requirements, hence motor size and weight.

Another advantage of the present invention is that it increases coolant oil life and decreases problems associated with degradation of the coolant oil.

Another advantage of the present invention is that it reduces off-focal radiation.

Another advantage of the present invention is that permits the use of high temperature, extended life coolants, even although such coolants may have limited radiation resistance.

The addition of radiation shielding to the housing advantageously facilitates continuous duty cycle operation.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
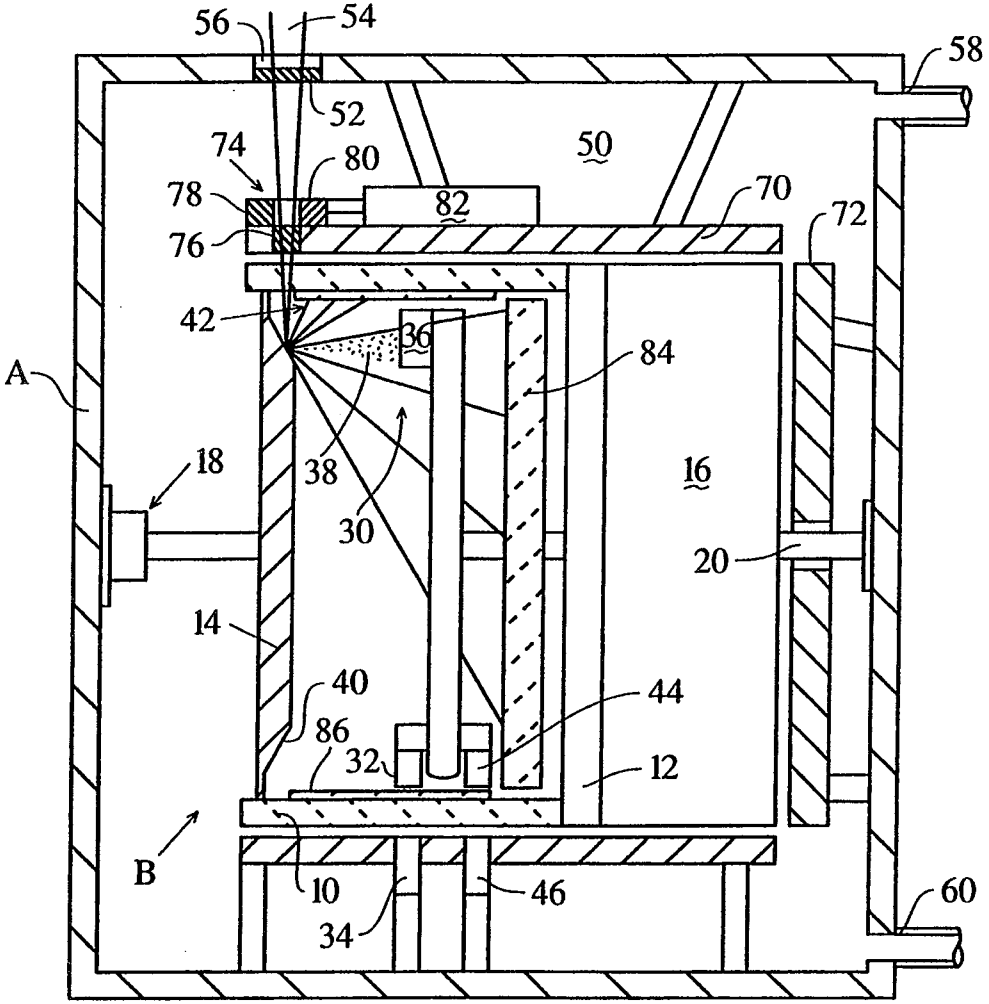
FIG. 1 is a transverse cross-sectional view of a rotating envelope and anode/stationary cathode x-ray tube assembly in accordance with the present invention.

With reference to FIG. 1, an x-ray tube assembly includes a housing A within which an x-ray tube B is mounted. The x-ray tube B includes an evacuated housing defined by a cylindrical radiation translucent wall portion 10, a rear wall 12, and an anode member 14. The evacuated housing is connected with a motor 16 which causes the evacuated housing to rotate about a central axis of the cylindrical wall portion 10. For more stable support, the anode member 14 is connected by a shaft and bearing assembly 18 with the housing A. In the embodiment of FIG. 1, the motor 16 rotates about a stationary central shaft 20 which is rigidly mounted to the housing A. Alternately, the motor 16 can be mounted exterior to the housing A with a rotating drive shaft extending between the motor and the rotatable housing.

A cathode assembly 30 is rotatably mounted within the evacuated housing. A first magnet 32 or preferably an array of magnets, is mounted to the cathode assembly 30 interior to the housing and another magnet 34, or preferably an array of magnets, is mounted to the stationary housing A. The magnets or magnet arrays have coupled magnetic fields to hold the cathode assembly 30 stationary as the evacuated housing rotates around it. The cathode assembly 30 includes a thermionic cathode cup 36 which includes a filament or the like which generates a cloud of electrons. A high potential, on the order of 150 kilowatts is created between at least the cathode cup 36 and the anode member 14. This draws the generated electrons into a tube current 38 which strikes an annular anode face 40 causing x-rays 42 to be emitted in all directions. Preferably, an inductive coupling, such as transformer elements 44, 46 are provided for conveying electrical energy across the rotating evacuated envelope to the cathode cup 36.

The emitted x-rays 42 travel through an oil filled reservoir 50 defined by the housing A. The housing A includes an x-ray transparent window 52 through which a beam 54 of x-rays is emitted. The window 52 is constructed of a material, such as aluminum, which is relatively transparent to x-rays yet prevents the coolant fluid in the reservoir 50 from leaking. An off-focal radiation collimator 56 is mounted in the window to reduce off-focal radiation. The housing includes fittings 58 and 60 for interconnection with a means for circulating the coolant fluid from the interior of the housing to a radiator or other cooling means, and back to the housing.

A cylindrical sleeve 70 extends around the cylindrical wall portion 10 and is displaced by a thin gap therefrom. Preferably, the gap between the sleeve 70 and the cylindrical wall portion 10 is only the thickness of a couple molecules of the coolant fluid 50. In this manner, the sleeve 70 and the cylindrical wall portion 10 form a journal bearing. A mounting means mounts the sleeve 70 to the housing A to hold it stationary. Analogously, a disk 72 is mounted to the housing A spaced by a small gap from the rotating rear wall of the tube assembly forming a disk-like bearing surface with a thin layer of hydraulic fluid lubricant.

Optionally, a means may be provided to urge the coolant oil through the gap of the journal bearing defined by the sleeve 70 and the peripheral wall 10. Such means might include an impeller at one end of the rotating structure, grooves in the rotating peripheral wall, or the like.

In the preferred embodiment, the sleeve 70 is constructed of a radiation opaque material which blocks the passage of the x-rays 42. The annular sleeve defines a slot or radiation transparent window 74 in alignment between the focal point on the anode surface 40 and the housing window 52. For better fluid dynamics, the sleeve window 74 preferably has a radiation transmissive element 76 along the inner surface. The sleeve window 74 is dimensioned to collimate the x-ray beam 54 and reduce off-focal radiation. Optionally, an additional collimator assembly 78 may be provided extending outward into the coolant fluid.

A radiation opaque member 80 is slidably mounted adjacent the sleeve window 74. A hydraulic cylinder 82 selectively moves the member 80 to adjust the beam dimensions and the off-focal collimation.

An additional radiation blocking disk or member 84 is provided within the evacuated housing to block radiation from exiting the evacuated housing through the rear wall 12. Alternately, the rear wall 12 can be constructed of a radiation opaque material. Optionally, a cylinder 86 of radiation opaque material can be mounted adjacent a portion of the journal bearing to protect the coolant in the gap. The cylinder can be mounted to the interior or exterior surface of the cylindrical wall portion 10. Alternately, a portion of the cylindrical wall portion can be constructed of a radiation opaque material.

Preferred radiation blocking materials include ceramic materials that have atoms with a high atomic number, such as a lead glass, barium glass, or the like.

Figure 2:
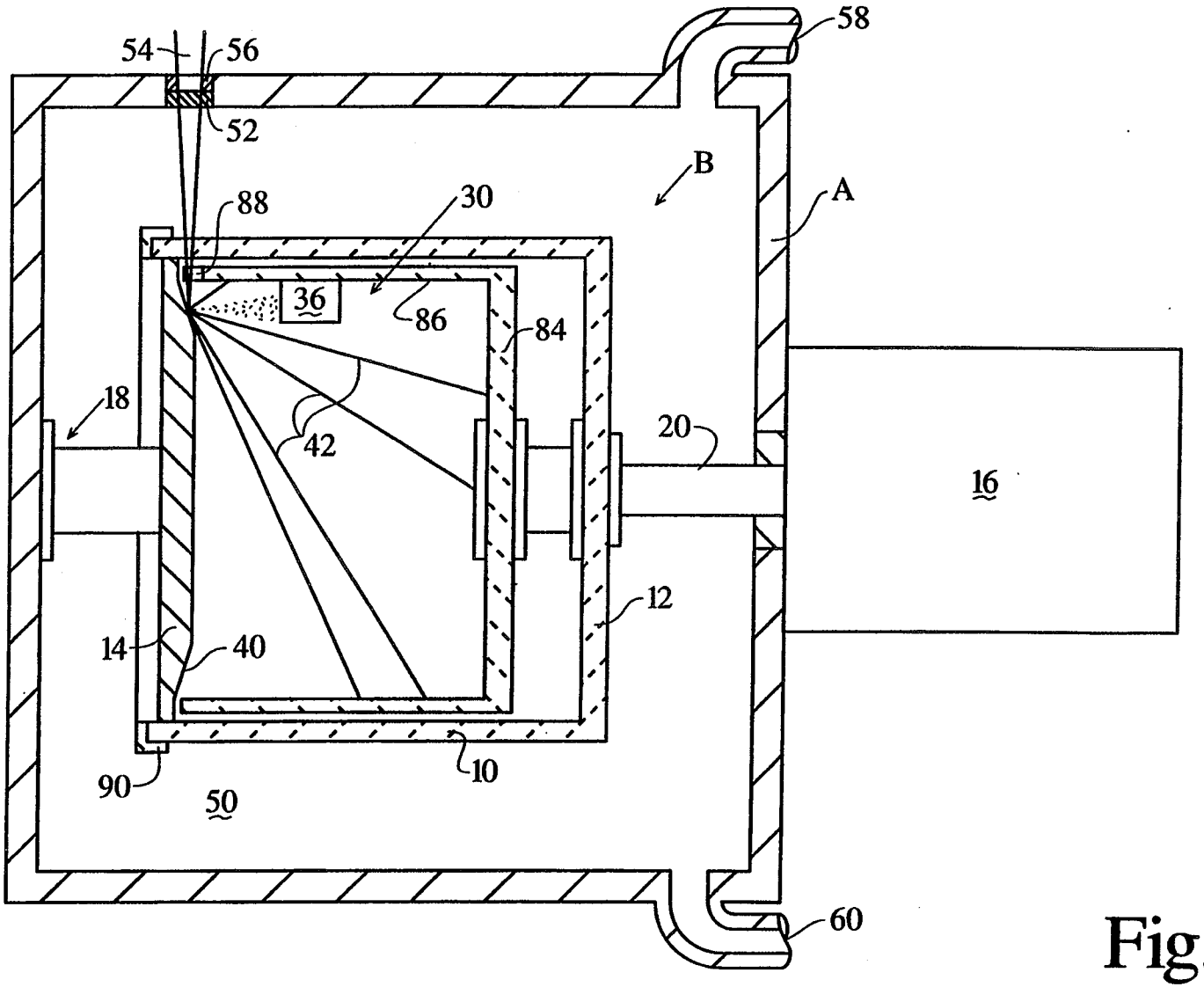
FIG. 2 is a transverse cross-sectional view of an alternate embodiment of the present invention.

In the embodiment of FIG. 2, the evacuated envelope again includes a cylindrical wall portion 10, a rear wall or disk 12, and an anode element 14. A motor 16 is mounted exterior to the housing A.

The cathode assembly 30 includes a ceramic, nonconductive disk 84 and a cylinder 86 of radiation opaque material. A notch 88 is cut out of one of the peripheral side walls adjacent the focal spot on an anode surface 40. A cathode cup 36 is mounted to the radiation opaque cylinder 86. For simplicity of illustration, the electrical connections for connecting the cathode CUD with an exterior electrical source and the magnetic arrangement for holding the cathode assembly stationary are not illustrated in FIG. 2.

Optionally, an x-ray blocking ring 90 may be clamped to the cylindrical wall portion 10 for rotation therewith. The ring is dimensioned such that it extends from the radiation beam 54 to a linear extension of the surface 40 of the anode.

Optionally, a journal bearing sleeve 70 may again be provided with the embodiment of FIG. 2. Due to the shielding effect of disk 84 and peripheral cylinder 86, even the cooling oil in the journal bearing gap is not exposed to radiation. The journal sleeve 70 may be constructed of a radiation transparent material.

Figure 3:
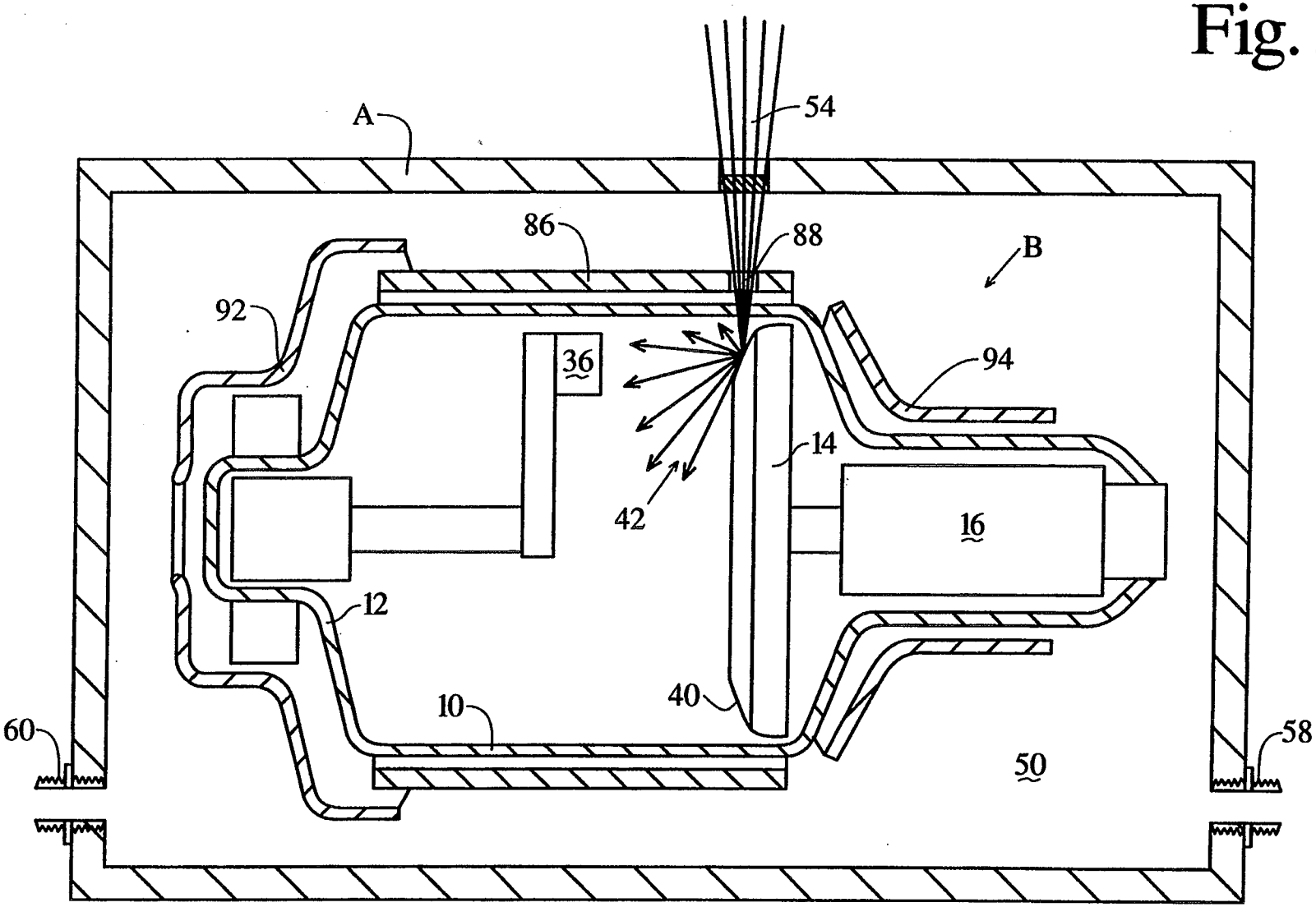
FIG. 3 is a transverse cross-sectional view of a stationary envelope x-ray tube assembly in accordance with the present invention.

In the embodiment of FIG. 3, the envelope remains stationary and an anode member 14 is rotated by a motor 16 disposed within the evacuated envelope. A stationary cathode cup 36 generates a cloud of electrons. A high voltage applied between the cathode and the anode cause the cloud of electrons to form into a tube current 38 impacting an anode surface 40 of the anode member 14 at a focal spot. X-rays 42 are emitted in all directions. An annular radiation opaque cylinder 86 is disposed around a central portion of the x-ray tube. A window or aperture 88 is defined in the x-ray opaque cylinder for passing an x-ray beam 54. The window 88 is dimensioned to collimate for off-focal radiation. A gap is defined between the radiation opaque cylinder 86 and the envelope to provide a path for coolant oil flow. In this manner, a small percentage of the oil contacts the envelope directly for more efficient cooling, but the vast majority of the oil is shielded from exposure to radiation. An additional radiation opaque member 92 prevents radiation from exiting the cathode end of the tube. An anode sleeve 94 blocks radiation which passes towards motor 16.

Figure 4:
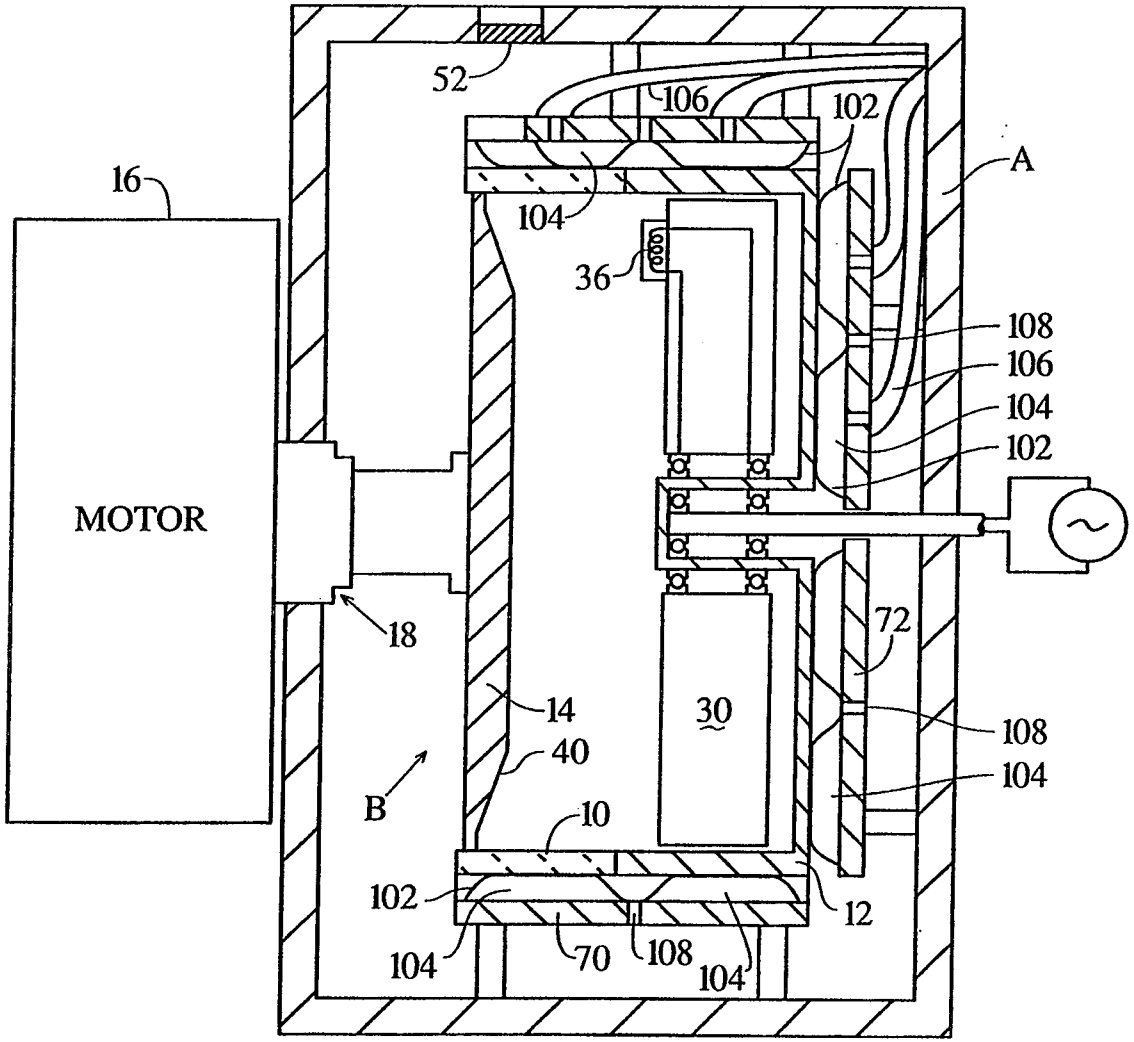
FIG. 4 is a transverse cross-sectional view of an alternate embodiment of the present invention with a thinner hydrodynamic film in the journal bearing assembly.
Figure 5:
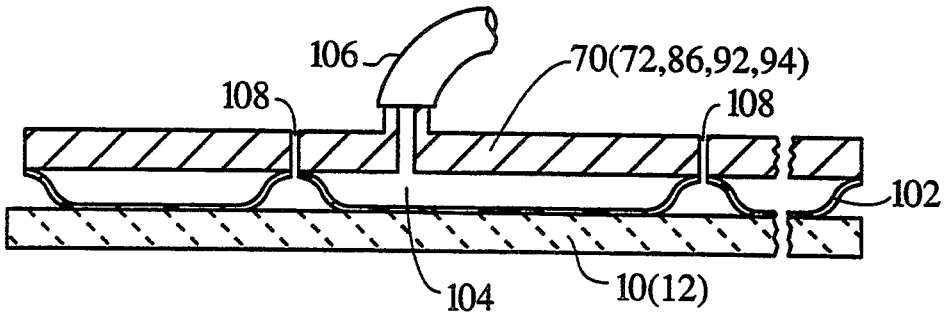
FIG. 5 is detailed cross-sectional view of an improved journal bearing assembly between the rotating envelope and a stationary sleeve.

With reference to FIGS. 4 and 5, frictional drag decreases as a gap 100 between the rotating portion and stationary journal bearing portions decrease. To minimize the gap between the envelope 10 and the journal bearing sleeves 70, 72, 86, 92, and 94, a diaphragm 102 is provided. The diaphragm 102 is connected to the journal bearing sleeve defining a sealed chamber 104 therebetween. A tube 106 is connected with a source of controllable hydraulic fluid exterior to the housing A. The hydraulic fluid is pumped into the sealed chamber 104 defined between the diaphragm 102 and the journal bearing sleeve 70, 72, 86, etc. until the diaphragm 102 is pressed firmly against the tube wall portion 10, 12, leaving only a thin hydrodynamic film of the coolant oil 50 therebetween.

Of course, rather than a single diaphragm 102, a plurality of diaphragms may be provided. The use of a plurality of diaphragms may be particularly advantageous in regions with complex contours such as between anode sleeve 94 of FIG. 3 and the corresponding portions of the x-ray tube wall portion.

In order to ensure an adequate supply of oil between the diaphragm 102 and the surface of the rotating x-ray tube wall 10, 12, a plurality of oil passages 108 are provided at intervals to assure an adequate supply of oil in the gap 100 to maintain the thin oil film. The oil may be provided passively, by a pump groove on the rotating envelope, or the like.

Figure 6:
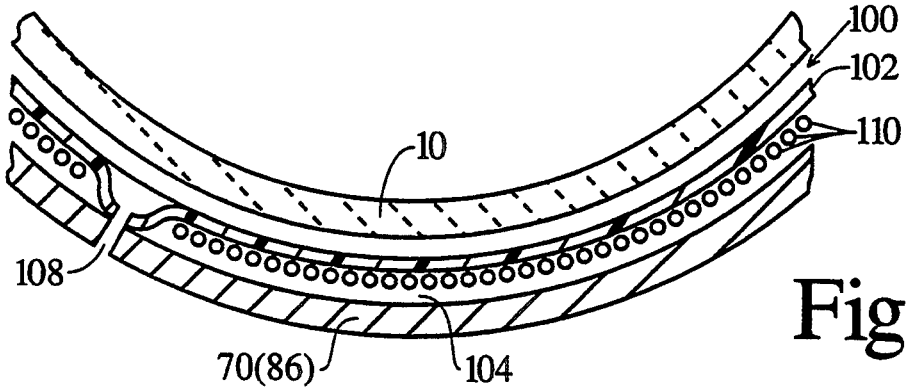
FIG. 6 is a detailed cross-sectional view of another improved journal bearing arrangement; and, FIG. 7 is a detailed cross-sectional view of yet another alternate embodiment of the journal bearing arrangement.

In FIG. 6, the distance between the diaphragm 102 and the x-ray tube wall portion 10 is exaggerated such that the coolant fluid gap 100 is illustrated more clearly. In order to stabilize the diaphragm wall, a plurality of rods 110 are provided. In the embodiment of FIG. 5, the rods 110 extend axially, parallel to the axis of rotation. Alternately, the rods may extend generally circumferentially, such as in a helical spring.

Figure 7:
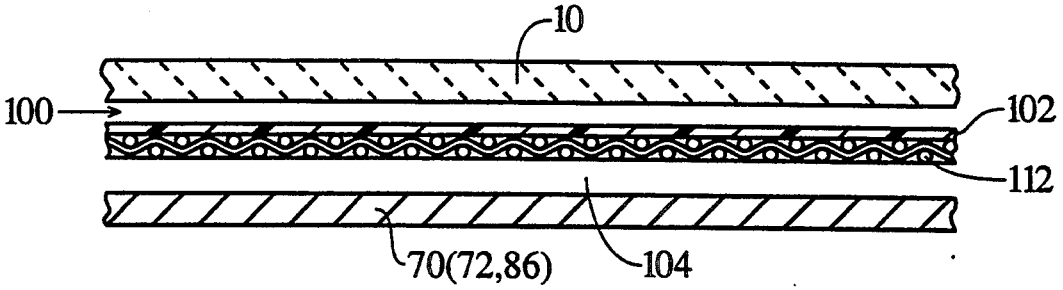

With reference to FIG. 7, the diaphragm 102 has a reinforcing layer 112, such as a woven fabric. The fabric may be molded into the rubber or elastomer of the diaphragm or merely line its inner wall. The fabric 110 is relatively stiff, analogous to an automobile tire, to stabilize the diaphragm surface.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. An x-ray tube assembly comprising:

a housing having a coolant fluid holding reservoir therein and an x-ray permeable window;

an x-ray tube disposed in the coolant fluid reservoir, the x-ray tube including a vacuum envelope having a cylindrical wall portion, the vacuum envelope being mounted within the housing for rotation about a central axis of the cylindrical wall portion;

a cylindrical sleeve disposed around the cylindrical vacuum envelope wall portion defining a thin gap therebetween for receiving the coolant fluid, such that the cylindrical wall portion, cylindrical sleeve, and coolant fluid define a journal bearing.

2. The x-ray tube assembly as set forth in claim 1 wherein the cylindrical sleeve is radiation opaque such that the cylindrical sleeve prevents radiation from within the vacuum envelope from passing therethrough shielding the coolant fluid in the reservoir.

3. The x-ray tube assembly as set forth in claim 2 wherein the cylindrical sleeve defines a radiation transparent opening therein, a beam of x-rays generated within the vacuum envelope passing through the radiation transparent opening in the cylindrical sleeve and the window in the housing.

4. The x-ray tube assembly as set forth in claim 3 further including an off-focal radiation collimator mounted adjacent the cylindrical sleeve radiation transparent opening.

5. The x-ray tube assembly as set forth in claim 3 further including means for adjusting at least one dimension of the cylindrical sleeve x-ray transparent opening.

6. The x-ray tube assembly as set forth in claim 3 further including an anode element disposed adjacent one end of the vacuum envelope cylindrical wall portion and a disk of radiation blocking material disposed adjacent an opposite end of the vacuum envelope cylindrical wall portion.

7. The x-ray tube assembly as set forth in claim 6 wherein the radiation blocking disk is disposed within the vacuum envelope.

8. The x-ray tube assembly as set forth in claim 1 further including radiation blocking material which is one of: (i) mounted to an interior surface of the vacuum envelope cylindrical wall portion, (ii) mounted to an outer surface of the vacuum envelope cylindrical wall portion, and (iii) an integral part of the vacuum envelope cylindrical wall portion.

9. The x-ray tube assembly as set forth in claim 1 further including:

an anode connected adjacent one end of the vacuum envelope cylindrical wall portion and connected for rotation therewith;

a cathode assembly including a disk of radiation blocking material rotatably mounted within the vacuum envelope;

a cylinder of radiation blocking material mounted to the x-ray blocking disk;

a cathode cup mounted interior to the cylinder of x-ray blocking material, the cathode cup generating electrons for forming a cathode current that impacts the anode to cause the generation of x-rays.

10. The x-ray tube assembly as set forth in claim 1 further including at least one diaphragm disposed between the cylindrical sleeve and the cylindrical vacuum envelope wall portion, the diaphragm being expansible to contract the thin gap therebetween.

11. The x-ray tube assembly as set forth in claim 10 further including a stabilizing means for stabilizing the diaphragm wall.

12. An x-ray tube assembly comprising:

a housing which defines a cooling fluid reservoir therein and which has an x-ray transmissive window therethrough;

an x-ray tube mounted within the housing, the x-ray tube including:

a vacuum envelope including a cylindrical wall portion rotatably mounted in the housing, an anode having an annular anode surface disposed generally transverse to a central axis of the cylindrical wall portion, the anode being connected with the cylindrical wall portion for rotation therewith, a cathode mounted within the vacuum envelope adjacent the anode surface;

a cylindrical sleeve of radiation blocking material stationarily disposed adjacent the vacuum envelope cylindrical wall portion and displaced therefrom by a thin gap, the radiation blocking sleeve defining a radiation passing window generally in alignment between the housing window and the annular anode surface.

13. The x-ray tube assembly as set forth in claim 12 further including an x-ray opaque element disposed adjacent a cathode end of the vacuum envelope.

14. The x-ray tube assembly as set forth in claim 12 further including an x-ray blocking disk mounted within the evacuated envelope on an opposite side of the cathode from the anode.

15. The x-ray tube assembly as set forth in claim 14 wherein the radiation blocking sleeve is mounted in the vacuum envelope between the cathode and the cylindrical wall portion.

16. The x-ray tube assembly as set forth in claim 15 wherein the radiation blocking sleeve and the x-ray blocking disk are interconnected.

17. An x-ray tube assembly comprising:

a housing which defines a cooling fluid reservoir therein and which has an x-ray transmissive window therethrough;

an x-ray tube mounted within the housing, the x-ray tube including:

a vacuum envelope including a cylindrical wall portion, an anode having an annular anode surface disposed generally transverse to a central axis of the cylindrical wall portion, a cathode mounted within the vacuum envelope adjacent the anode surface, a means for causing relative rotational movement between the anode surface and the cathode;

a cylindrical sleeve of radiation blocking material disposed adjacent the vacuum envelope cylindrical wall portion, the radiation blocking sleeve defining a radiation passing window generally in alignment between the housing window and the annular anode surface;

an x-ray opaque element around an anode end of the evacuated envelope.

18. An x-ray tube assembly comprising:

a housing which defines a cooling fluid reservoir therein and which has an x-ray transmissive window therethrough;

an x-ray tube mounted within the housing, the x-ray tube including:

a vacuum envelope including a rotatably mounted cylindrical wall portion, an anode having an annular anode surface disposed generally transverse to a central axis of the cylindrical wall portion, the anode being mounted to the cylindrical wall portion for rotation therewith, a cathode mounted within the vacuum envelope adjacent the anode surface, the cathode being disposed generally stationary within the rotating evacuated envelope;

a cylindrical sleeve of radiation blocking material mounted outside the cylindrical wall portion and displaced therefrom, the radiation blocking sleeve a radiation passing window generally in alignment between the housing window and the annular anode surface.

19. An x-ray tube assembly comprising:

a housing which defines a cooling fluid reservoir therein and which has an x-ray transmissive window therethrough;

an x-ray tube mounted within the housing, the x-ray tube including:

a vacuum envelope including a rotatably mounted cylindrical wall portion, an anode having an annular anode surface disposed generally transverse to a central axis of the cylindrical wall portion, a cathode mounted within the vacuum envelope adjacent the anode surface, a means for causing relative rotational movement between the anode surface and the cathode;

a cylindrical sleeve of radiation blocking material displaced from the cylindrical wall portion by a thin gap and supported by the housing such that the sleeve remains stationary as the vacuum envelope rotates, the radiation blocking sleeve defining a radiation passing window generally in alignment between the housing window and the annular anode surface.

20. The x-ray tube assembly as set forth in claim 19 further including at least one diaphragm element mounted between the sleeve and the cylindrical wall portion, the diaphragm being selectively expansible under pressure to contract the thin gap.

21. The x-ray tube assembly as set forth in claim 20 further including a plurality of oil passages through the sleeve through which hydraulic coolant fluid is caused to flow into the thin gap between the diaphragm and the cylindrical wall portion.

22. The x-ray tube assembly as set forth in claim 20 further including means for stabilizing the diaphragm.

23. The x-ray tube assembly as set forth in claim 22 wherein the stabilizing means includes one of woven fabric plies and rods.

24. The x-ray tube assembly as set forth in claim 19 wherein the sleeve radiation blocking and further including an off-focal radiation collimator mounted adjacent the radiation blocking sleeve radiation passing window.

25. The x-ray tube assembly as set forth in claim 19 wherein the sleeve is radiation blocking and further including means for adjusting at least one dimension of the radiation blocking sleeve x-ray passing window.

* * * * *